US012331595B2

(12) United States Patent
Harman et al.

(10) Patent No.: US 12,331,595 B2
(45) Date of Patent: Jun. 17, 2025

(54) SHAPED CUTTER FOR DRILL BIT WITH POINT-LOADED REINFORCING RIBS

(71) Applicant: Halliburton Energy Services, Inc., Houston, TX (US)

(72) Inventors: John Harman, Denver, CO (US); William Brian Atkins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/079,389

(22) Filed: Dec. 12, 2022

(65) Prior Publication Data

US 2024/0191579 A1 Jun. 13, 2024

(51) Int. Cl.
*E21B 10/633* (2006.01)
*E21B 10/43* (2006.01)

(52) U.S. Cl.
CPC ..... *E21B 10/633* (2013.01); *E21B 10/43* (2013.01)

(58) Field of Classification Search
CPC ..... E21B 10/633; E21B 10/43
See application file for complete search history.

(56) References Cited

U.S. PATENT DOCUMENTS

| | | | | |
|---|---|---|---|---|
| 7,743,855 | B2 | 6/2010 | Moss | |
| 8,037,951 | B2 | 10/2011 | Shen et al. | |
| 8,783,387 | B2 | 7/2014 | Durairajan et al. | |
| 10,022,840 | B1 | 7/2018 | Miess | |
| 10,385,623 | B2 | 8/2019 | DiGiovanni et al. | |
| D924,949 | S | 7/2021 | Mortensen | |
| 11,215,012 | B2 | 1/2022 | Chen et al. | |
| 11,377,910 | B2 | 7/2022 | Zhao et al. | |
| 2016/0032657 | A1 | 2/2016 | Zhang et al. | |
| 2020/0224500 | A1* | 7/2020 | Dubose | E21B 10/5673 |
| 2022/0251905 | A1* | 8/2022 | Duffy | E21B 10/5676 |
| 2022/0412170 | A1* | 12/2022 | Morozov | E21B 10/55 |

FOREIGN PATENT DOCUMENTS

CN 103328151 A 9/2013

OTHER PUBLICATIONS

Filing Receipt for U.S. Appl. No. 17/531,628, filed Nov. 19, 2021.

* cited by examiner

*Primary Examiner* — Dany E Akakpo
(74) *Attorney, Agent, or Firm* — Michael Jenney; C. Tumey Law Group PLLC

(57) ABSTRACT

A shaped cutter is disclosed for use on a drill bit. In one or more example, the shaped cutter includes a substrate including a proximal end and a distal end and defining a cutter axis extending between the proximal and distal ends. A cutting table secured to the proximal end of the substrate includes a cutting face with a central boss axially extending from the cutting face and a plurality of ribs radially extending across the cutting face from the boss to a periphery of the cutting table. The cutting face may recede axially from the periphery towards the central boss, such as by defining a planar section, a plurality of intersecting planar sections, and/or a concave (e.g., frustoconical) shape between adjacent ribs.

16 Claims, 4 Drawing Sheets

SHAPED CUTTER FOR DRILL BIT WITH POINT-LOADED REINFORCING RIBS

BACKGROUND

Wells are constructed in subterranean formations in an effort to extract hydrocarbon fluids such as oil and gas. A wellbore may be drilled with a rotary drill bit mounted at the lower end of a drill string. The drill string is assembled at the surface of a wellsite by progressively adding lengths of tubular drilling pipe to reach a desired depth. The drill bit is rotated by rotating the entire drill string from the surface of the well site and/or by rotating the drill bit with a downhole motor incorporated into a bottomhole assembly (BHA) of the drill string. As the drill bit rotates against the formation, cutters on the drill bit disintegrate the formation in proximity to the drill bit. Drilling fluid ("mud") is circulated through the drill string and the annulus between the drill string and the wellbore to lubricate the drill bit and remove cuttings and other debris to surface.

Rotary drill bits are generally categorized as fixed cutter (FC) bits having discrete cutters secured to a bit body at fixed positions (i.e., fixed cutters), roller cone (RC) bits having rolling cutting structures (i.e., roller cones), or hybrid bits comprising both fixed cutters and rolling cutting structures. A fixed cutter is typically secured to the bit body with the cutting table at a particular orientation and position, thereby exposing some portion of the cutting table to the formation. A fixed cutter traditionally has a cylindrical overall shape with a round, flat cutting table. However, as diamond manufacturing continues to improve, more nuanced cutting table shapes continue to be developed that provide various technical advantages.

BRIEF DESCRIPTION OF THE DRAWINGS

These drawings illustrate certain aspects of some of the embodiments of the present disclosure and should not be used to limit or define the method.

DETAILED DESCRIPTION

This disclosure encompasses shaped cutters for drill bits, along with associated methods of making and using such shaped cutters and drill bits. The disclosed shaped cutters generally include a cutting table with a plurality of ribs radially extending across the cutting face from the a periphery of the cutting table toward a central boss to stiffen and/or reinforce the cutting table. The cutting face may have a negative rake angle, such that the cutting face recedes axially from the periphery toward the central boss. The cutting face may comprise a planar section, a plurality of intersecting planar sections, and/or a frustoconical portion between adjacent ribs. The ribs help reinforce and stiffen the cutting table, as well as providing point loading where a tip of a rib is oriented to engage a formation during drilling. Benefits of such cutters may include improved cleaning, structural integrity, the described point loading, and increased cutting performance and/or efficiency.

The plurality of reinforcing ribs also provides redundancy. For example, if one reinforcing rib becomes worn or damaged, the cutter may be removed and re-attached at another rotational position about its cutter axis to align another of the reinforcing ribs for engagement with the formation. In another aspect, multiple reinforcing ribs of different sizes may be provided such as for different depths of cut, or having different shapes corresponding to different available mounting locations on the drill bit. These and other aspects are discussed below in relation to various examples.

Figure 1:
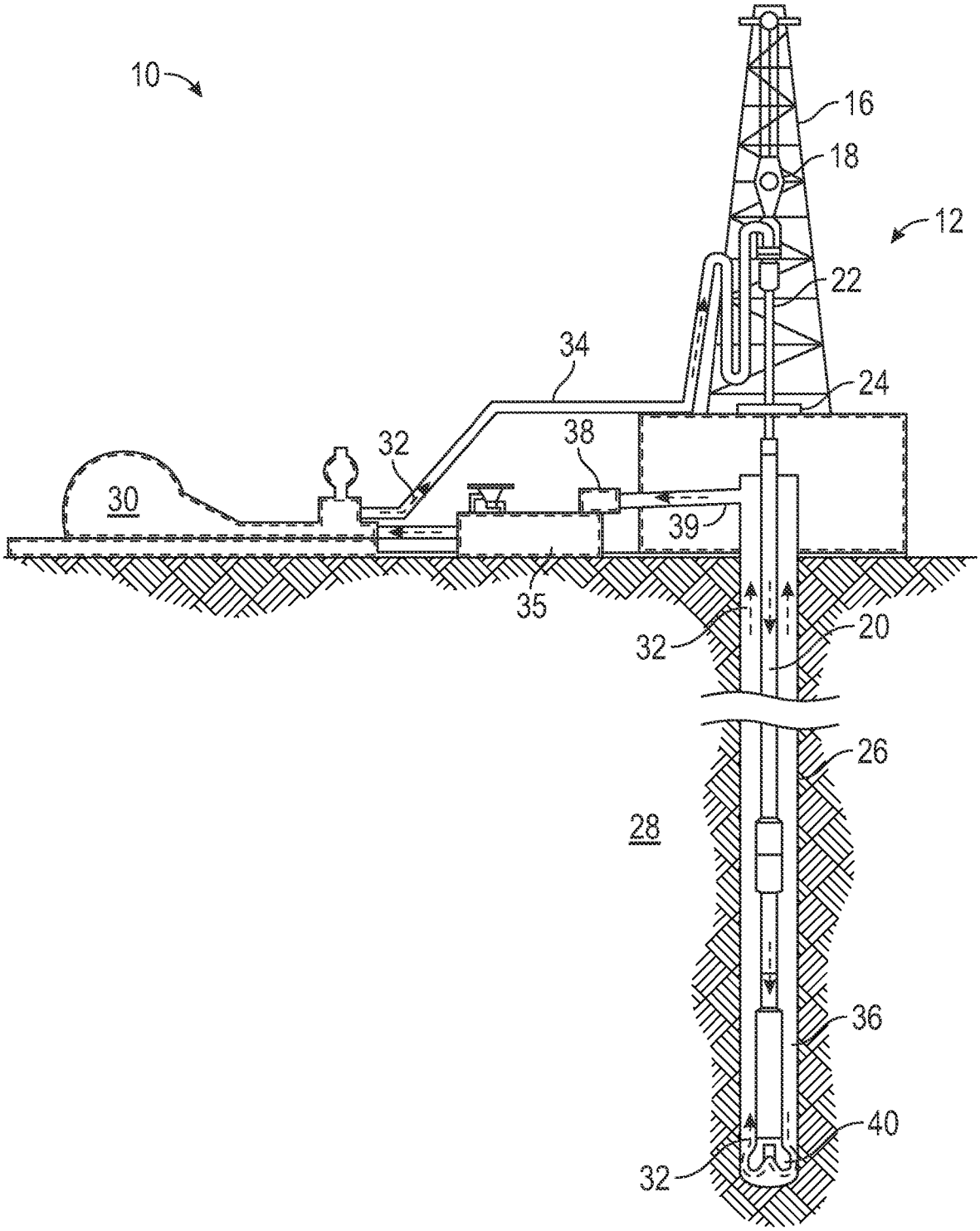
FIG. 1 is an elevation, partially cross-sectional view of a representative well site at which a wellbore may be formed with a drill bit and shaped cutters according to the disclosure.

FIG. 1 is an elevation, partially cross-sectional view of a representative well site 10 at which a wellbore may be formed by drilling and other operations. While FIG. 1 generally depicts land-based drilling, the principles described herein are applicable to subsea drilling operations that employ floating or sea-based platforms and rigs, without departing from the scope of the disclosure. As illustrated, a drilling rig 12 may include a drilling platform 14 that supports a derrick 16 having a traveling block 18 for raising and lowering a drill string 20. The drill string 20 may include, but is not limited to, drill pipe and coiled tubing, as generally known to those skilled in the art. A kelly 22 supports the drill string 20 as it is lowered through a rotary table 24. A rotary drill bit 40 is attached to the distal end of the drill string 20 and may be rotated by via rotation of the drill string 20 from the well surface and/or a downhole motor. The drill bit 40 is a wellbore forming tool that is used to initially form a wellbore 26 in a subterranean formation 28. Other wellbore forming tools may be included on the drill string for use in certain drilling operations, such as one or more hole opener and/or reamer to selectively widen a portion of the wellbore 28, or a coring bit used to obtain and retrieve a sample of the formation for analysis.

The drill bit 40 may be a fixed-cutter or hybrid drill bit having one or more fixed cutters, including one or more shaped cutters as disclosed herein to enhance rock removal. A pump 30 (e.g., a mud pump) circulates drilling fluid (i.e., "mud") 32 through a feed pipe 34 and to the kelly 22, which conveys the drilling fluid 32 downhole through the interior of the drill string 20 and through one or more orifices in the drill bit 40. The drilling fluid 32 is then circulated back to the surface via an annulus 36 defined between the drill string 20 and the walls of the wellbore 26. At the surface, the recirculated or spent drilling fluid 32 exits the annulus 36 and may be conveyed to one or more fluid processing unit(s) 38 via an interconnecting a flow line 39. After passing through the fluid processing unit(s) 38, a cleaned drilling fluid 32 is deposited into a nearby retention pit 35 (i.e., a mud pit). While illustrated as being arranged at the outlet of the wellbore 26 via the annulus 36, those skilled in the art will readily appreciate that the fluid processing unit(s) 38 may be arranged at any other location in the drilling rig 10 to facilitate its proper function, without departing from the scope of the scope of the disclosure.

Figure 2:
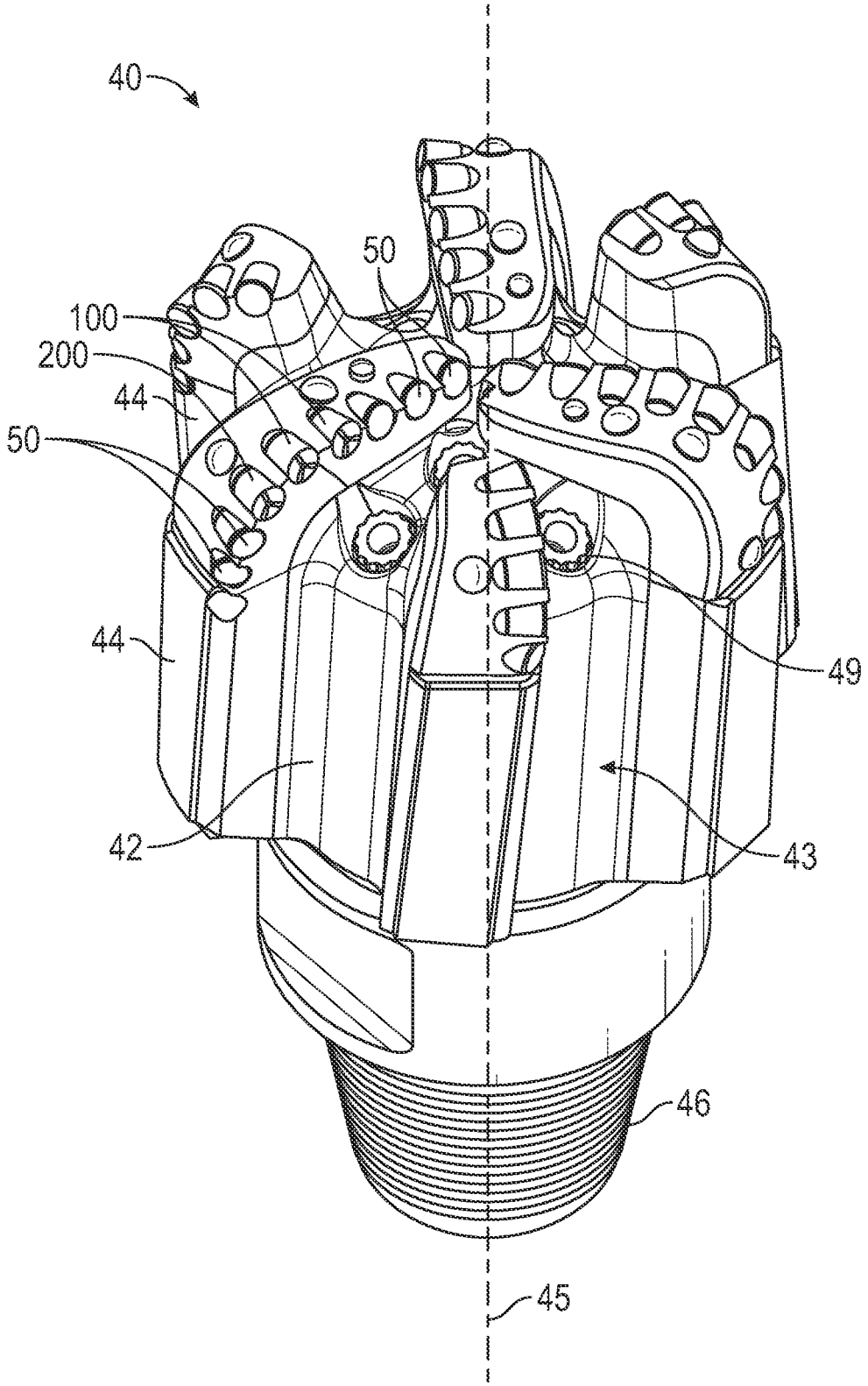
FIG. 2 is a perspective view of an example configuration for the drill bit according to aspects of the present disclosure.

FIG. 2 is a perspective view of an example configuration for the drill bit 40 according to aspects of the present disclosure. The drill bit 40 is oriented in an upward direction for ease of illustrating drill bit features, but would more commonly be directed downwardly vertically or at an angle of deviation to vertical during drilling. The drill bit 40 includes a rigid bit body 42. The bit body 42 may be described as a fixed cutter (FC) type bit body in that it supports having cutters, e.g., cutters 50, 100, 200 secured to the bit body 42 at various fixed locations around the bit body 42. The drill bit in any given example may include any number of shaped cutters according to this disclosure, optionally in combination with other shaped cutters or conventional round/cylindrical cutters. By way of example and not by limitation, the drill bit 40 in FIG. 2 includes at least one blade having two shaped cutters 100 of the general configuration shown in FIGS. 3-4 below and one shaped cutter 200 having the general configuration shown in FIGS. 5-6 below. Different shaped cutters may be selected, for example, according to different cutter locations on the drill bit 40.

The bit body 42 defines a bit axis 45 about which the drill bit 40 may rotate while drilling. The bit axis 45 may pass centrally through the bit body 42 and/or coincide at least approximately with a center of mass of the drill bit 40. The bit axis 45 is typically aligned with an axis of a drill string or other conveyance to which the drill bit 40 is coupled. Drill bits generally may be connected in any of a variety of ways to a drill string, coiled tubing, or other conveyance to allow for rotation about the bit axis 45. In this example, the drill bit 40 may include a metal shank 46 with a threaded connection for securing to a drill string. This connection may generally align the bit axis 45 with an axis of the drill string or other desired axis of rotation.

The bit body 42 includes a plurality of blades 44 formed on the exterior of the bit body 42. The blades 44 are radially extending and circumferentially spaced from each other with respect to the bit axis 45, defining fluid flow paths or junk slots 43 therebetween. The blades 44 also support the various fixed cutters 50, 60. While drilling, an axial force such as weight on bit (WOB) may be applied in a direction of the bit axis 45, such that the cutters 50, 60 engage the formation being drilled. Simultaneously, the drill bit 40 is rotated about the bit axis 45 to engage the earthen formation to cut material ("rock") from the formation. Drilling fluid circulated downhole may lubricate the drill bit 40 and remove the cuttings and other fluid contaminants to the surface, such as generally described above in relation to FIG. 1. Nozzles 49 may be direct the flow of drilling fluid through the drill bit and to the junk slots 43 to help remove cuttings/chips of formation material.

A rate of penetration (ROP) may be determined by drill bit parameters such as depth of cut and choice of cutters, along with drilling parameters, such as WOB and revolutions per minute (RPM). The choice of cutters includes a typical round or cylindrical cutter 50, having a generally round shape and flat/smooth cutting face, in combination with one or more shaped cutters 100, 200 of this disclosure. The examples of shaped cutters 100, 200 discussed further below each include a plurality of circumferentially spaced ribs that may be oriented for point loading with the formation being drilled. These shaped cutters may include ROP performance and/or cutter durability as compared with a conventionally shaped round or cylindrical cutters 50.

Figure 3:
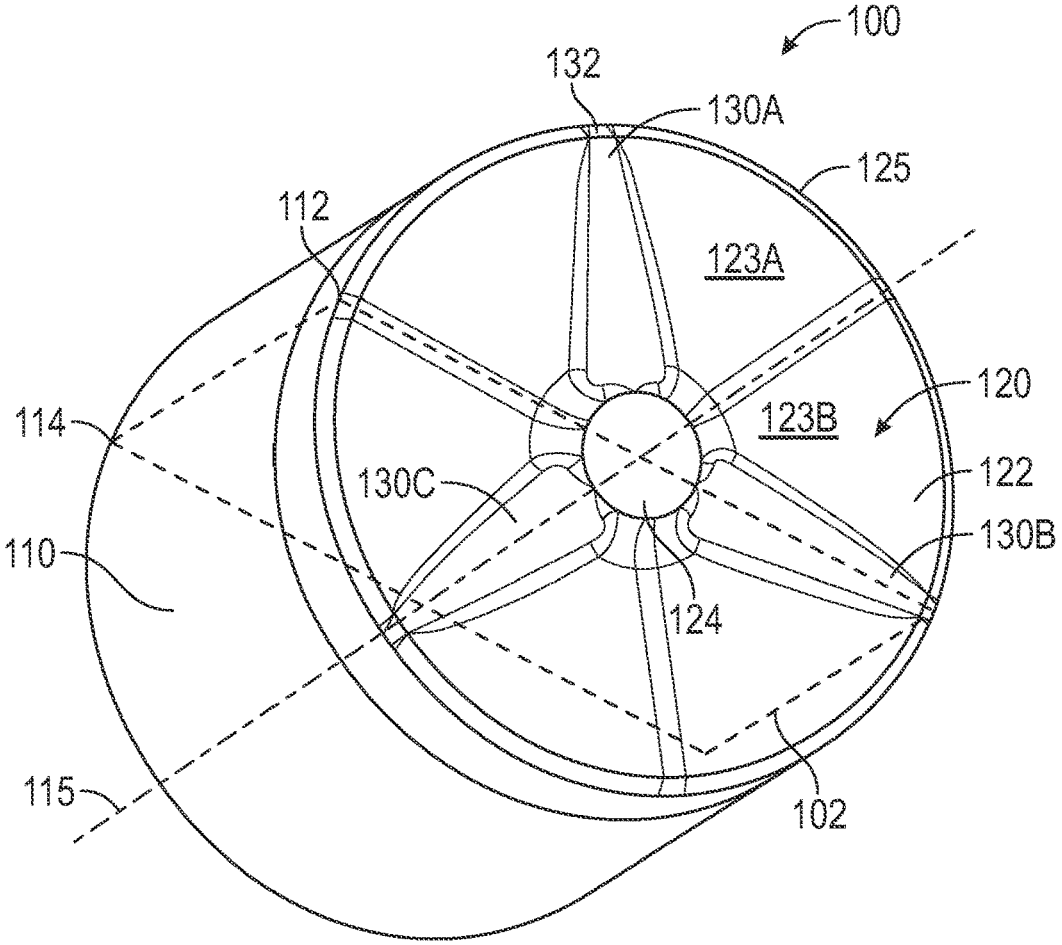
FIG. 3 is an enlarged, perspective view of a shaped cutter according to a first example configuration having a cutting table with a generally circular periphery.

FIG. 3 is an enlarged, perspective view of a shaped cutter 100 for a fixed-cutter drill bit according to a first example configuration whose cutting table 120 has a generally circular periphery 125. The shaped cutter 100 includes a substrate 110 including a proximal end 112 and a distal end 114 and defining a cutter axis 115 extending between the proximal end 112 and distal end 114. A cutting table generally indicated at 120 is secured to the proximal end 112 of the substrate 110. The cutting table 120 has a periphery 125 that is circular about the cutter axis 115 and is chamfered in this example. The chamfer may be uniform, e.g., with a consistent dimension as it extends along the periphery. The chamfer or portions thereof may alternatively be non-uniform, such as to accommodate a varying geometry along the periphery, for example, a chamfer that varies from a location at the tip 132 of a rib 132 to a location between two ribs 132. The cutting table 120 in this and other configurations may be formed by subjecting a diamond-based material, such as polycrystalline diamond (PCD), to a high-temperature, high-pressure (HTHP) press cycle, wherein grains of diamond-based material are sintered to form the diamond table 120. Typically, the diamond table 120 is simultaneously bonded to the substrate 110 in the same press cycle, although diamond tables can alternatively be formed separately and subsequently bonded to their substrates. The shaped cutter 100 may have round/cylindrical substrate 110 as illustrated, but the cutting table 120 is shaped (i.e., a shaped cutting table) to define a cutting face 122 that deviates from a conventional round/cylindrical shape. During manufacturing, the shaped cutting table 120 may be initially formed with a round, flat shape and subsequently shaped using laser ablation, electrical discharge machining (EDM), or other suitable machining or forming technique, or a combination thereof.

The cutting table 120 of this shaped cutter 100 includes a central boss 124 axially extending from the cutting face 122. A plurality of ribs 130 are individually indicated at 130A, 130B, and 130C, respectively. These ribs 130 radially extend across the cutting face 122 from the boss 124 to the periphery 125 of the cutting table 120. The ribs 130 may help reinforce the cutting table 120, such as to modify stress and/or strain along the cutting table 120, e.g., to stiffen the cutting table 120, which, despite being formed of a very hard and high-strength material, is also subjected to very high stresses and strains during drilling and may also contain residual stresses during manufacturing. Thus, the ribs 130 help promote durability during drilling, e.g., resisting fracturing during high loads, by reinforcing the cutting table 120. Simultaneously, the ribs 130 also provide point loading when oriented on the drill bit so a respective one of the tips 132 engages the formation during drilling.

The cutting face 122 recedes axially from the periphery 125 towards the central boss 124. In this example, the cutting face 122 includes two planar sections 123A, 123B intersecting one another between each pair of adjacent ribs 130 where the cutting face 122 recedes axially from the periphery 125 towards the central boss 124. Alternatively, the shaped cutter 100 could include a different number of planar sections, e.g., a single planar section or more than two planar sections, between each pair of adjacent ribs 130. As another alternative, the cutting face 122 may have a concave (e.g., frustoconical) rather than planar shape to recede axially from the periphery 125 toward the central boss 124. In any of these examples, the cutting face 122 is non-orthogonal to the cutter axis 115, where it recedes axially from the periphery 125 towards the central boss 124, i.e., at a negative angle.

In preferred embodiments, a shaped cutter has either three ribs, such as illustrated, or four ribs. However, embodiments with as few as two ribs or as many as five or more ribs are possible within the scope of this disclosure. The ribs 130 are preferably evenly circumferentially spaced, as shown. However, the ribs 130 could alternatively have different spacings between different pairs of consecutive ribs, e.g., a different circumferential spacing between the first and second ribs 130A, 130B than between the second and third ribs, 130B, 130C. A plurality of circumferentially spaced ribs is useful, in one aspect, so any one of the ribs 130 may be oriented for point loading with the formation. For example, if the tip 132 of one rib becomes worn, the shaped cutter 100 may be removed and repositioned about its cutter axis 110 during a repair or maintenance procedure to position a different one of the ribs 130 for point loading with the formation.

Figure 4:
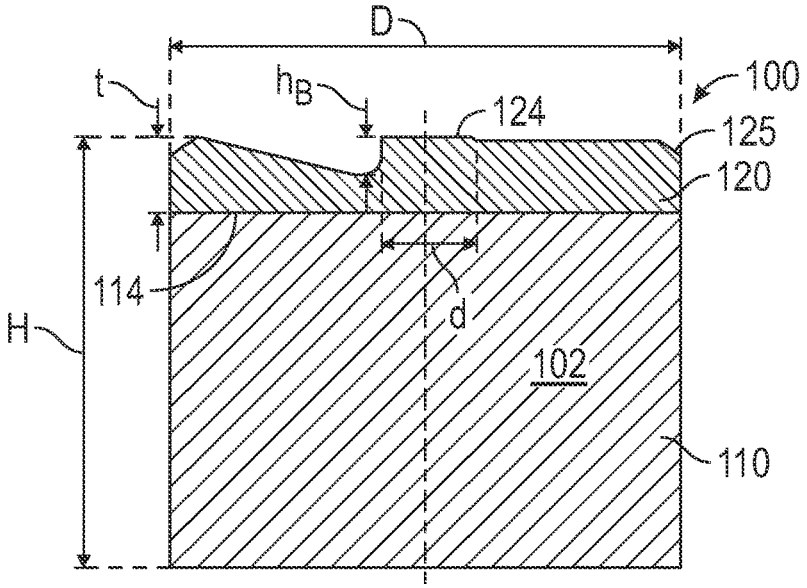
FIG. 4 is a cross-section of the shaped cutter of FIG. 3 along a reference plane bisecting the shaped cutter through the cutter axis.

FIG. 4 is a cross-section of the shaped cutter 100 of FIG. 3 along a reference plane 102 bisecting the shaped cutter 100 through the cutter axis 115. The shaped cutter 100 has an overall height "H" and an overall diameter (width) "D." The diameter D of this and any of the examples herein may be between 0.3 and 1.1 inches (approximately 7.5 to 28 mm). A height "$h_B$" of the central boss 124 above the cutting face may be set equal to an expected depth of cut for the shaped cutter 100. The central boss 124 may have a diameter "d" of between 0.2 and 0.7 times the overall diameter D of the shaped cutter 100. The height/top of the central boss 124 is preferably at or below a maximum height of the periphery 125 of the cutting table 120, which is equal to the overall cutter height H in at least this example. A chamfered portion defines a circular facet of the periphery 125 that preferably terminates prior to an interface between the proximal end 114 of the substrate 110 and the cutting table 120. In this example, at least half a thickness "t" of the cutting table remains below where the chamfered portion terminates. Each rib may also define a bump where the tip of the rib extends into the chamfer. This bump may help apply the desired point loading at the tip.

Figure 5:
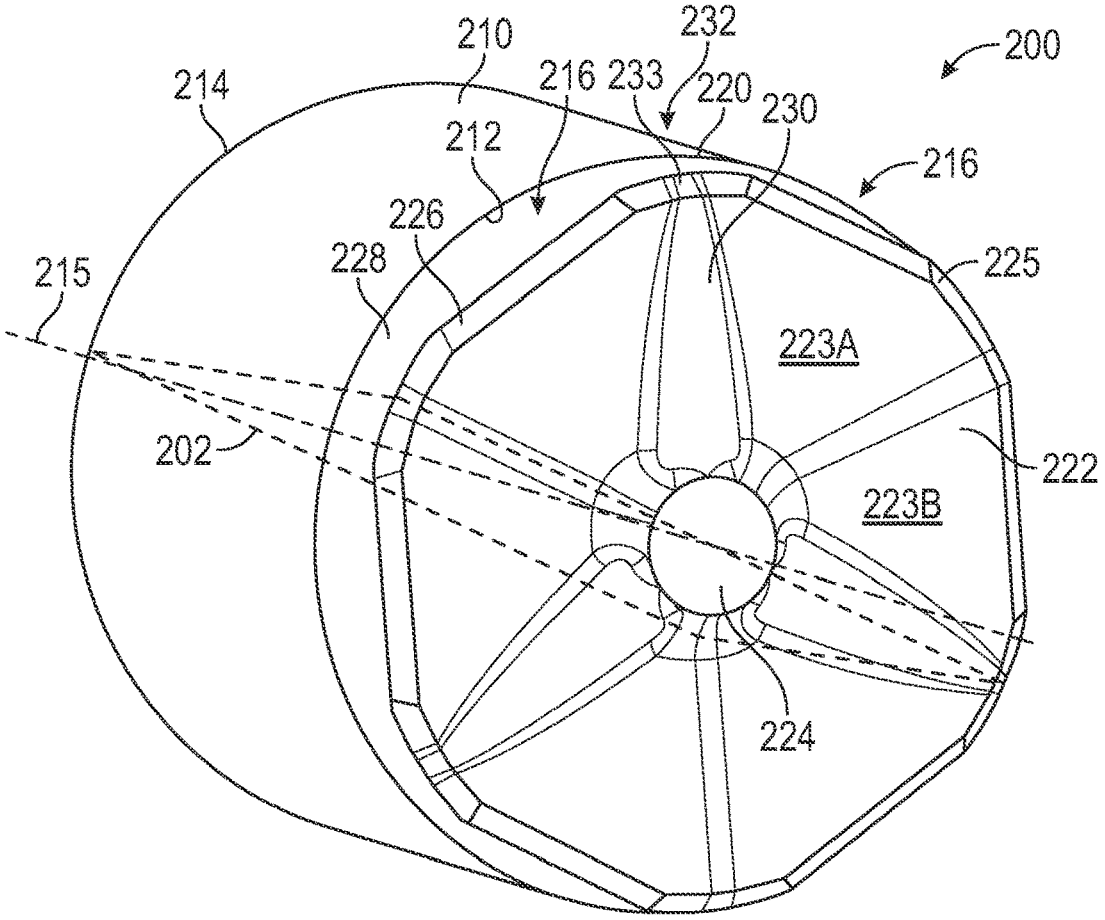
FIG. 5 is an enlarged, perspective view of a shaped cutter according to a second example configuration having a cutting table with a generally polygonal periphery.

FIG. 5 is an enlarged, perspective view of a shaped cutter 200 according to a second example configuration whose cutting table 220 has a generally polygonal periphery 225. The shaped cutter 200 includes a substrate 210, which may be identical or similar to the FIG. 3 embodiment, including defining a cutter axis 215 extending through proximal and distal ends 212, 214. The cutting table 220 is secured to the proximal end 212 of the substrate 210. As in the prior example, the cutting table 220 may be formed and bonded to the substrate in an HTHP press cycle or formed separately and subsequently bonded to the substrate 210. The shaped cutter 200 may again have round/cylindrical substrate 210 as illustrated. However, the periphery 225 is polygonal rather than circular about the cutter axis 215, resulting in flanks 216 on opposing sides of each ridge. The flanks 216 may include facets or chamfers as further described below that are part of the geometry and interact with the rock. During manufacturing, the shaped cutting table 220 may be initially formed with a round, flat shape and subsequently shaped using laser ablation, electrical discharge machining (EDM), or other suitable machining or forming technique, or a combination thereof.

As in the preceding example, the cutting table 220 of this shaped cutter 200 includes a central boss 224 axially extending from the cutting face 222 and a plurality of ribs 230 radially extending across the cutting face 222 from the boss 224 to the periphery 225. The function, geometry, and arrangement of these ribs 230 is generally as described with respect to the FIG. 3 example, except where may be otherwise noted. The cutting face 222 also recedes axially from the periphery 225 towards the central boss 224 along one or more planar sections 223A, 223B, or alternatively, with a frustoconical shape, to recede axially from the periphery 225 toward the central boss 224. In any of these examples, the cutting face 222 is non-orthogonal to the cutter axis 215 where it recedes axially from the periphery 225 towards the central boss 224.

The cutting table 220 is multifaceted in FIG. 5, in that the periphery 225 includes a first facet 226 extending from the cutting face 222 and a second facet 228 extending from the first facet 226 toward the substrate 210. These facets 226, 228 may be along just a portion of the periphery 225, typically along the flanks 216. In this example, the facets may not extend fully through each tip 232 of the rib 230. For example, at least a portion of each tip 232 may protrude at least slightly beyond a tip chamfer having a tip chamfer width $W_C$, as shown, defining a bump or dome 233 where the tips 232 extends beyond the chamfer to interact with the rock. A plurality of contiguous first and second facets 226, 228 may each extend circumferentially and continuously along the periphery 225 to help define the generally polygonal shape of that periphery 225. For example, each facet 226, 228 may be substantially planar as shown, analogous to segments of a polygon, in which case the facets 226, 228 may be described as planar facets (like individual chamfers coinciding with each leg of the polygonal shape). Each facet 226 along the periphery 225 is at an angle with a contiguous one of the facets 226 and each facet 228 along the periphery 225 is at an angle with a contiguous one of the facets 228 in keeping with the generally polygonal shape of the periphery 225.

Still referring to FIG. 5, a flank chamfer size (e.g., width) may be determined by a width of the ribs 230 at their tip (i.e., cutting tip width). The flank chamfer size may be defined within a range of the tip. For example, the flank chamfer size could be between 0.2 to 4.0 times the size of a tip chamfer at the tip 232 of each rib 230. A face edge chamfer could comprise any of a variety of chamfer types, with a width in the range of between 0.002 to 0.080 inches (approximately 0.051 mm to 2.03 mm).

Figure 6:
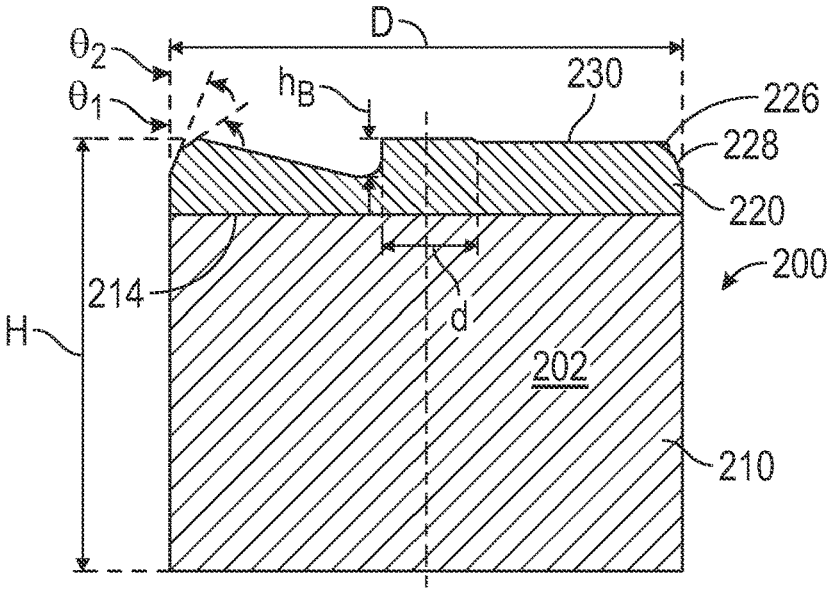
FIG. 6 is a cross-section of the shaped cutter of FIG. 5 along a reference plane bisecting the shaped cutter through the cutter axis.

FIG. 6 is a cross-section of the shaped cutter 200 of FIG. 5 along a reference plane 202 bisecting the shaped cutter 200 through the cutter axis 215. Certain aspects of this cross-sectional shape may be similar to the prior cross-sectional example of FIG. 4. For example, the shaped cutter 200 has an overall height "H" and an overall diameter (width) "D." A height "$h_B$" of the central boss 224 above the cutting face may be set equal to an expected depth of cut for the shaped cutter 200. The central boss 224 may have a diameter "d" of between 0.2 and 0.7 times the overall diameter D of the shaped cutter 200. The height/top of the central boss 224 is preferably at or below a maximum height of the periphery 225 of the cutting table 220, which is equal to the overall cutter height H in at least this example.

The shaped cutter 200, including its cross-sectional shape, differs in other respects from the example of FIGS. 3-4, such as by virtue of the multifaceted, polygonal periphery 225. The multifaceted portion of the polygonal periphery 225 preferably terminates prior to an interface between the proximal end 214 of the substrate 210 and the cutting table 220. In particular, the first facet 226 extends from the cutting face 222 to the second facet 228, and the second facet 228 extends from the first facet 226 toward the substrate 210. The facet details are included for purposes of illustration, with the understanding that the tip of the rib 230 may extend beyond one or both facets 226, 228 and the facets may terminate at different locations in other embodiments. The second facet 228 terminates at the outer diameter D of the shaped cutter 200 coinciding with the diameter of the substrate. At least half a thickness "t" of the cutting table 220 preferably remains, as shown, below where the second facet 228 terminates. The first facet 226 may be at an angle $\theta_1$ of between 30 and 90 degrees with respect to the cutter axis. The second facet 228 may be at an angle $\theta_2$ of between 0 and 30 degrees with respect to the cutter axis.

Though specific example shapes of shaped cutters have been disclosed herein for purposes of discussion, it should be recognized that other shapes may be devised according to the present teachings, including any suitable combinations of any of the features of the various examples, and that all such other shapes should be considered to be within the scope of this disclosure.

A related method may include drilling a wellbore using such a drill bit with shaped cutters taught in the disclosure. For example, a drilling method may include rotating a drill bit about a bit axis with a plurality of cutters engaging the formation. Each cutter in this method may comprise a substrate including a proximal end and a distal end and defining a cutter axis extending between the proximal and distal ends. A cutting table secured to the proximal end of the substrate may include a cutting face with a central boss axially extending from the cutting face and a plurality of ribs radially extending across the cutting face from the boss to a periphery of the cutting table. Each shaped cutter may be oriented with a tip of one of the ribs positioned for engaging the formation. The plurality of ribs may provide redundancy, such as to reposition the cutter when the tip of one of the ribs becomes worn or damaged. The plurality of ribs may alternatively provide different sizes or shapes, enabling the selection of one of the ribs based on a desired depth of cut or location on the drill bit.

Accordingly, the present disclosure may provide a shaped cutter and related drill bit, drilling methods, and other related aspects. These may include any of the various features disclosed herein, including one or more of the following examples.

Example 1. A shaped cutter for a fixed-cutter drill bit, comprising: a substrate including a proximal end and a distal end and defining a cutter axis extending between the proximal and distal ends; and a cutting table secured to the proximal end of the substrate, the cutting table including a cutting face with a central boss axially extending from the cutting face and a plurality of stiffening ribs radially extending across the cutting face from the boss to a periphery of the cutting table.

Example 2. The shaped cutter of Example 1, wherein the plurality of stiffening ribs is three or four stiffening ribs.

Example 3. The shaped cutter of Example 1 or 2, wherein the stiffening ribs are evenly circumferentially spaced.

Example 4. The shaped cutter of Example 1-3, wherein the cutting face recedes axially from the periphery towards the central boss.

Example 5. The shaped cutter of Example 4, further comprising one or more planar sections where the cutting face recedes axially from the periphery towards the central boss.

Example 6. The shaped cutter of Example 4-5, wherein a height of the central boss above the cutting face is equal to an expected depth of cut for the cutter.

Example 7. The shaped cutter of Example 1-6, wherein the central boss has a radius of between 0.2 and 0.7 times a radius of the substrate.

Example 8. The shaped cutter of Example 1-7, wherein a height of the central boss is at or below a maximum height of the periphery of the cutting table.

Example 9. The shaped cutter of Example 1-8, wherein the periphery of the cutting table is circular.

Example 10. The shaped cutter of Example 1-9, wherein the periphery of the cutting table is polygonal.

Example 11. The shaped cutter of Example 10, wherein the periphery of the cutting table is multifaceted, including a first facet extending from the cutting face and a second facet extending from the first facet toward the substrate.

Example 12. The shaped cutter of Example 11, wherein the second facet terminates prior to an interface between the cutting table and the substrate.

Example 13. The shaped cutter of Example 12, wherein at least half a thickness of the cutting table remains below where the second facet terminates.

Example 14. The shaped cutter of Example 11-13, wherein the first facet is at an angle of between 30 and 90 degrees with respect to the cutter axis and the second facet is at an angle of between 0 and 30 degrees with respect to the cutter axis.

Example 15. The shaped cutter of Example 1-14, wherein a diameter of the cutter is between 0.3 and 1.1 inches.

Example 16. A fixed cutter drill bit, comprising: a bit body defining a bit axis and having a plurality of blades extending therefrom; and a plurality of cutters secured to the blades, including one or more shaped cutter, each shaped cutter including a substrate and a cutting table secured to the proximal end of the substrate, the cutting table including a cutting face with a central boss axially extending from the cutting face and a plurality of stiffening ribs radially extending across the cutting face from the boss to a periphery of the cutting table.

Example 17. The fixed cutter drill bit of Example 16, wherein the cutting face recedes axially from the periphery towards the central boss.

Example 18. The fixed cutter drill bit of Example 16-17, further comprising one or more planar sections or frusto-conical concave sections where the cutting face recedes axially from the periphery towards the central boss.

Example 19. A method of drilling, comprising: rotating a drill bit about a bit axis, the drill bit having a plurality of cutters, including one or more shaped cutter, each shaped cutter including a substrate and a cutting table secured to the proximal end of the substrate, the cutting table including a cutting face with a central boss axially extending from the cutting face and a plurality of stiffening ribs radially extending across the cutting face from the boss to a periphery of the cutting table, with a tip of one of the stiffening ribs positioned to engage the formation.

Example 20. The method of Example 19, further comprising: selectively removing the one or more shaped cutter from the drill bit and re-attaching the one or more shaped cutter with a tip of another one of the stiffening ribs engaging the formation.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the Examples below. Also, the terms in the Examples have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A shaped cutter for a fixed-cutter drill bit, comprising:

a substrate including a proximal end and a distal end and defining a cutter axis extending between the proximal and distal ends; and a cutting table secured to the proximal end of the substrate, the cutting table including a cutting face with a central boss axially extending from the cutting face and a plurality of ribs radially extending across the cutting face from the central boss to a periphery of the cutting table, wherein the cutting face recedes axially from the periphery towards the central boss, and wherein the cutting face includes two planar sections disposed between each pair of adjacent ribs of the plurality of ribs, wherein a respective intersection between the two planar sections disposed between each pair of adjacent ribs extends where the cutting face recedes axially from the periphery towards the central boss.

2. The shaped cutter of claim 1, wherein the plurality of ribs is three or four ribs.

3. The shaped cutter of claim 1, wherein the ribs are evenly circumferentially spaced.

4. The shaped cutter of claim 1, wherein a height of the central boss above the cutting face is equal to an expected depth of cut for the cutter.

5. The shaped cutter of claim 1, wherein the central boss has a radius of between 0.2 and 0.7 times a radius of the substrate.

6. The shaped cutter of claim 1, wherein a height of the central boss is at or below a maximum height of the periphery of the cutting table.

7. The shaped cutter of claim 1, wherein the periphery of the cutting table is circular.

8. The shaped cutter of claim 1, wherein the periphery of the cutting table is polygonal.

9. The shaped cutter of claim 8, wherein the periphery of the cutting table is multifaceted, including a first facet extending from the cutting face and a second facet extending from the first facet toward the substrate.

10. The shaped cutter of claim 9, wherein the second facet terminates prior to an interface between the cutting table and the substrate.

11. The shaped cutter of claim 10, wherein at least half a thickness of the cutting table remains below where the second facet terminates.

12. The shaped cutter of claim 9, wherein the first facet is at an angle of between 30 and 90 degrees with respect to the cutter axis and the second facet is at an angle of between 0 and 30 degrees with respect to the cutter axis.

13. The shaped cutter of claim 1, wherein a diameter of the cutter is between 0.3 and 1.1 inches.

14. A fixed cutter drill bit, comprising:

a bit body defining a bit axis and having a plurality of blades extending therefrom; and a plurality of cutters secured to the blades, including one or more shaped cutter, wherein each shaped cutter comprises:

a substrate; and a cutting table secured to the proximal end of the substrate, the cutting table including a cutting face with a central boss axially extending from the cutting face and a plurality of ribs radially extending across the cutting face from the central boss to a periphery of the cutting table, wherein the periphery of the cutting table has a chamfer, wherein a respective tip of each rib of the plurality of ribs protrudes beyond the chamfer for point loading a formation, wherein the cutting face recedes axially from the periphery towards the central boss, and wherein the cutting face includes two planar sections disposed between each pair of adjacent ribs of the plurality of ribs, wherein a respective intersection between the two planar sections disposed between each pair of adjacent ribs extends where the cutting face recedes axially from the periphery towards the central boss.

15. A method of drilling, comprising:

rotating a drill bit about a bit axis, the drill bit having a plurality of cutters, including one or more shaped cutter, each shaped cutter including a substrate and a cutting table secured to a proximal end of the substrate, the cutting table including a cutting face with a central boss axially extending from the cutting face and a plurality of ribs radially extending across the cutting face from the central boss to a periphery of the cutting table, with a tip of one of the ribs positioned to engage a formation, wherein the cutting face recedes axially from the periphery towards the central boss, and wherein the cutting face includes two planar sections disposed between each pair of adjacent ribs of the plurality of ribs, wherein a respective intersection between the two planar sections disposed between each pair of adjacent ribs extends where the cutting face recedes axially from the periphery towards the central boss.

16. The method of claim 15, further comprising:

selectively removing the one or more shaped cutter from the drill bit and re-attaching the one or more shaped cutter with a tip of another one of the ribs engaging the formation.

* * * * *